United States Patent [19]

Watarai et al.

[11] Patent Number: 4,594,304

[45] Date of Patent: Jun. 10, 1986

[54] ELECTROPHOTOGRAPHIC LIGHT-SENSITIVE HYDRAZONE MATERIAL

[75] Inventors: Shu Watarai; Seiji Horie, both of Kanagawa, Japan

[73] Assignee: Fuji Photo Film Co., Ltd., Kanagawa, Japan

[21] Appl. No.: 708,461

[22] Filed: Mar. 5, 1985

[30] Foreign Application Priority Data

Mar. 6, 1984 [JP] Japan ..... 59-42370

[51] Int. Cl.[4] ..... G03G 5/06; G03G 5/14

[52] U.S. Cl. ..... 430/59; 430/70; 430/72; 430/73; 430/74; 430/76; 430/77; 430/78; 430/79; 564/251

[58] Field of Search ..... 430/59, 70, 72, 73, 430/74, 76, 77, 78, 79; 564/251

[56] References Cited

U.S. PATENT DOCUMENTS

| | | | |
|---|---|---|---|
| 4,278,747 | 7/1981 | Murayama et al. | 430/59 X |
| 4,399,208 | 8/1983 | Takasu et al. | 430/59 |
| 4,420,548 | 12/1983 | Sakai et al. | 430/59 |
| 4,465,857 | 8/1984 | Neumann et al. | 564/251 |

*Primary Examiner*—Roland E. Martin

*Attorney, Agent, or Firm*—Sughrue, Mion, Zinn, Macpeak and Seas

[57] ABSTRACT

An electrophotographic light-sensitive material is described, comprising, provided on an electrically conductive support, a light-sensitive layer containing at least one hydrazone compound selected from particular groups of hydrazone compounds.

20 Claims, 5 Drawing Figures

ELECTROPHOTOGRAPHIC LIGHT-SENSITIVE HYDRAZONE MATERIAL

FIELD OF THE INVENTION

The present invention relates to electrophotographic light-sensitive materials, and more particularly, to electrophotographic light-sensitive materials having a layer containing a novel electric charge transporting substance and electrophotographic light-sensitive materials having a layer containing a novel photoconductive substance.

BACKGROUND OF THE INVENTION

The photoconductive process for electrophotographic light-sensitive materials is generally considered to include (1) a step of generating an electric charge pattern by exposing a material to light, and (2) a step of transporting electric charges.

As an example of conducting the steps (1) and (2) in the same substance, there is a selenium light-sensitive plate. On the other hand, as an example of conducting steps (1) and (2) in different substances, a combination of amorphous selenium and poly-N-vinylcarbazole have been well known. The process in which the steps (1) and (2) are conducted with different substances has advantages, such as that the range of selection of materials that can be used for the light-sensitive material is expanded, and, consequently, electrophotographic characteristics such as sensitivity, receiving electric potential, etc., of the light-sensitive materials are improved, and substances advantageous for producing a coating film of the light-sensitive material can be selected from a wide range.

Substances that have hitherto been used as photoconductive raw materials for light-sensitive materials to be used in the electrophotographic process include inorganic substances such as selenium, cadmium sulfide, zinc oxide, etc.

As disclosed by Carlson in U.S. Pat. No. 2,297,691, the electrophotographic process uses a photoconductive material comprising a support coated with a substance which is electrically insulating in the dark, the electric resistance of which changes according to the amount of exposure to which it is subjected during imagewise exposure. Uniform surface electric charges are provided on the photoconductive material in the dark, generally, after carried out dark adaptation for a suitable period of time. This material is then imagewise exposed to light with an irradiation pattern having an effect of reducing surface electric charges according to relative energy contained in various parts of the irradiation pattern. The surface electric charges or electrostatic latent image remaining on the surface of the photoconductive substance layer (light-sensitive layer) is then brought into contact with a suitable electroscopic indicating substance, referred to as a toner, to form a visible image. The toner can be allowed to adhere to the surface of the light-sensitive layer according to the electric charge pattern regardless of being contained in an electrically insulating liquid or in a dried carrier. The indicating substance adhering to the surface can be fixed by known means such as heat, pressure, or solvent vapor. The electrostatic latent image can be transferred to the second support (for example, paper or film, etc.). The electrostatic latent image can be developed on the second support after it is transferred thereto. The electrophotographic process is any image forming process in which an image is formed as in the above described manner.

In such an electrophotographic process, fundamental characteristics required for the light-sensitive materials are that: (1) electrification can be carried out in the dark so as to have a suitable electric potential, (2) disappearance of electric charge in the dark is small, and (3) the electric charge can be rapidly removed by exposing to light. The above described inorganic substances used hitherto have various faults, although simultaneously with having many advantages. For example, selenium, which is widely used at present, sufficiently satisfies the above described requirements (1)–(3), but it has faults in that production thereof requires severe conditions which increase cost for production, it is difficult to form a belt shape because of lack of flexibility, and it requires careful handling because it is sensitive to heat and mechanical impact. Cadmium sulfide and zinc oxide have been used as light-sensitive materials by dispersing in a binder resin. However, they can not repeatedly used in such a state to the desired extent, because of mechanical faults that develop with respect to smoothness, hardness, tensile strength, friction resistance, etc.

In recent years, for the purpose of overcoming these faults of inorganic substances, electrophotographic light-sensitive materials using various kinds of organic substance have been proposed, and some of them have been put in practical use. For example, there are light-sensitive materials composed of poly-N-vinylcarbazole and 2,4,7-trinitrofluorene-9-one (described in U.S. Pat. No. 3,484,237), those wherein poly-N-vinylcarbazole is sensitized with a pyrylium salt type dye (described in Japanese Patent Publication No. 25658/73) and light-sensitive materials comprising an eutectic crystal complex composed of a dye and a resin as a main component (described in Japanese Patent Application (OPI) No. 10735/72), etc. (the term "OPI" as used herein refers to a published unexamined Japanese Patent Application).

Further, high-speed electrophotographic light-sensitive materials comprising a combination of a substance which generates an electric charge by light (hereinafter referred to as an electric charge generating substance and a substance which can convey the formed electric charge (hereinafter referred to as an electric charge transporting substance) have been proposed. For example, light-sensitive materials in which an electric charge transporting layer is provided on an electric charge generating layer are described in U.S. Pat. No. 3,791,826, light-sensitive materials in which an electric charge generating layer is provided on an electric charge transporting layer are described in U.S. Pat. No. 3,573,906, and light-sensitive materials having a light-sensitive layer in which an electric charge generating substance is dispersed in an electric charge transporting substance are described in U.S. Pat. No. 3,764,315. With respect to light-sensitive materials of this type, various electric charge generating substances have been proposed, but there has been no proposal of really useful electric charge transporting substances. A good electric charge transporting substance (1) which allows sufficient transmission of light having wave-lengths generate electric charges in the electric charge generating substance to pass through it to the electric charge generating substance, (2) sufficiently retains an electric potential when electrified, and has an ability of rapidly transporting electric charges generated in the electric charge generating substance.

As a result of extensive studies, the present inventors have found that hydrazone compounds represented by formulae (I), (II), and (III) described hereinafter are really useful electric charge transporting substances for electrophotographic light-sensitive materials, and thus the present invention has been attained.

Examples of hydrazone compounds used as electrophotographic light-sensitive materials are disclosed in U.S. Pat. No. 3,717,462 (corresponding to Japanese Patent Publication No. 8137/73), Japanese Patent Application (OPI) Nos. 59143/79 (corresponding to U.S. Pat. No. 4,150,987), 52063/80 (corresponding to U.S. Pat. No. 4,338,388) and 52064/80, etc. However, these compounds are condensed polynuclear substances or N-alkylamino substituted substances.

The present inventors have already found that electrophotographic light-sensitive materials having a light-sensitive layer containing N-arylamino substituted substances are remarkably improved in stability to oxidation caused by ozone generating by corona discharging, which is a fatal drawback of the above described known light-sensitive materials, stability to light and heat, dark decay properties, etc., and they have characteristics that sensitivity is high, residual electric potential which causes fog is low, variation of residual electric potential or sensitivity caused by repeated use is small, and durability is excellent. Thus, they have been proposed as inventions in Japanese Patent Applications (OPI) Nos. 11350/82 and 104144/82 (corresponding to U.S. Pat. Nos. 4,403,025 and 4,396,694, respectively. The present invention provides electrophotographic light-sensitive materials having excellent characteristics similar to the above described prior inventions, by using novel hydrazone derivatives having a dimer structure.

SUMMARY OF THE INVENTION

An object of the present invention is to provide electrophotographic light-sensitive materials having an electrophotographic light-sensitive layer containing a novel electric charge transporting substance.

Another object of the present invention is to provide electrophotographic light-sensitive materials having an electrophotographic light-sensitive layer having high sensitivity and low residual electric potential.

A further object of the present invention is to provide electrophotographic light-sensitive materials having an electrophotographic light-sensitive layer which is stable to oxidation caused by ozone generating by corona discharging, light and heat, wherein dark decay of the electric potential is small, wherein the degree of increase or variation of residual electric potential caused by repeated use is small, and wherein variation of the sensitivity is small.

A further object of the present invention is to provide electrophotographic light-sensitive materials for which handling and waste disposal can be safely carried out, which has an electrophotographic light-sensitive layer containing a substance, as an electric charge transporting substance or an electric charge generating substance, having no toxicity or low toxicity, and which can be synthesized from raw materials having no toxicity or low toxicity.

A further object of the present invention is to provide a stable electric charge transporting layer or electric charge generating layer having high film strength, excellent uniformity, and a lesser degree of deterioration due to fatigue.

Thus, the present invention relates to an electrophotographic light-sensitive material comprising, provided on an electrically conductive support, a light-sensitive layer containing at least one hydrazone compound selected from the group consisting of compounds represented by formulae (I), (II), or (III).

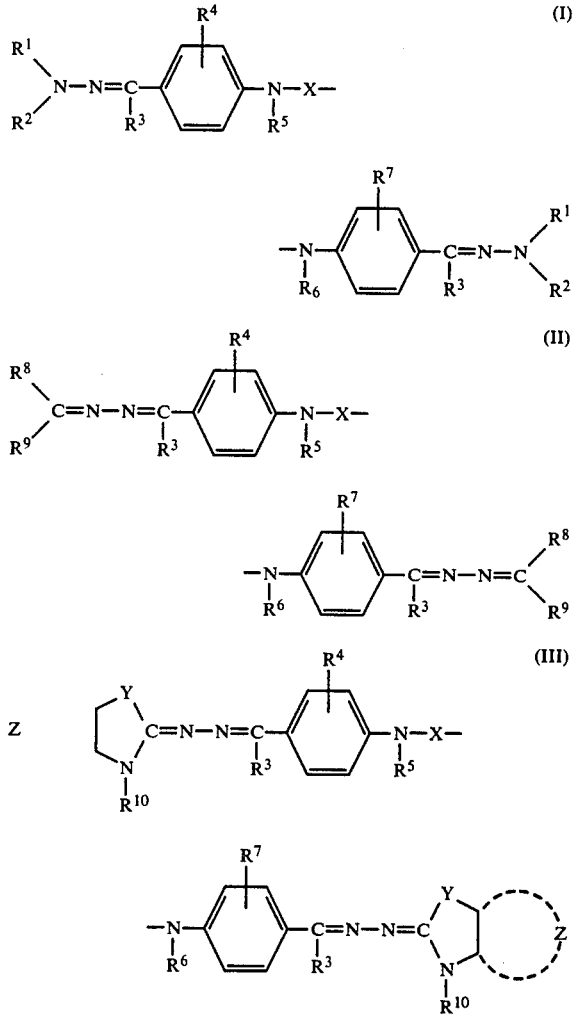

In the formulae, $R^1$ and $R^2$ each represents an unsubstituted or substituted straight chain or branched chain alkyl group having from 1 to 12 carbon atoms, an unsubstituted or substituted straight chain or branched chain aralkyl group having from 7 to 20 carbon atoms, or a monovalent group formed by removing one hydrogen atom from a mononuclear or 2- to 4-nuclear condensed polycyclic aromatic hydrocarbon having from 6 to 20 carbon atoms (i.e., an aryl group), or $R^1$ and $R^2$ together form a heterocyclic ring preferably having from 5 to 16 carbon atoms. Of course, $R^1$ and $R^2$ may be identical or different from each other.

$R^3$ represents a hydrogen atom, an unsubstituted or substituted straight chain or branched chain alkyl group having from 1 to 12 carbon atoms, an unsubstituted or substituted aralkyl group having from 7 to 20 carbon atoms, or an unsubstituted or substituted aryl group having from 6 to 20 carbon atoms.

$R^4$ and $R^7$ each represents a hydrogen atom, an unsubstituted or substituted straight chain or branched chain alkyl group having from 1 to 12 carbon atoms, an unsubstituted or substituted aralkyl group having from 7 to 20 carbon atoms, an unsubstituted or substituted aryl group having from 6 to 20 carbon atoms, a halogen atom, an alkoxy group having from 1 to 12 carbon atoms, or an aryloxy group having from 6 to 14 carbon atoms. Of course, $R^4$ and $R^7$ may also be identical or different from each other.

$R^5$, $R^6$, $R^8$, $R^9$, and $R^{10}$ each represents an unsubstituted or substituted straight chain or branched chain alkyl group having from 1 to 12 carbon atoms, an unsubstituted or substituted straight chain or branched chain aralkyl group having from 7 to 20 carbon atoms, or an unsubstituted or substituted aryl group having from 6 to 20 carbon atoms, or $R^5$ and $R^6$ together form a N-containing heterocyclic group (i.e., by bonding to each other) preferably having 3 to 12 carbon atoms, and, of course, $R^5$ and $R^6$ may be identical or different from each other.

X represents the formula

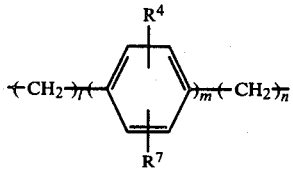

wherein l and n are each 0 or an integer of 1 to 6, m is 0 or 1, and $l+n+m>0$, $R^4$ and $R^7$ can each represent the same substituents as described above for $R^4$ and $R^7$, or $R^4$ and $R^7$ together form a condensed polynuclear aromatic ring, Y represents an oxygen atom, a sulfur atom, a selenium atom, an unsubstituted or substituted imino group, or an unsubstituted or substituted methylene group, and, Z represents an atomic group forming a benzene or naphthalene ring.

DETAILED DESCRIPTION OF THE INVENTION

Figure 1:
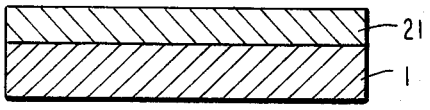
FIGS. 1 to 4 are enlarged sectional views in the thickness direction of an electrophotographic light-sensitive material according to the present invention.

For $R^1$ and $R^2$ representing unsubstituted alkyl groups, examples thereof include a methyl group, ethyl group, propyl group, butyl group, pentyl group, hexyl group, octyl group, nonyl group, dodecyl group, isopropyl group, isobutyl group, isopentyl group, 4-methylpentyl group, sec-butyl group, and tert-butyl group, For $R^1$ and $R^2$ representing alkyl groups having substituents, examples of the substituents include chlorine, bromine, and fluorine as halogen atoms, a methoxy group, ethoxy group, propoxy group, butoxy group and pentyloxy group as alkoxy groups, a phenoxy group, o-tolyloxy group, m-tolyloxy group, p-tolyloxy group, 1-naphthyloxy group, and 2-naphthyloxy group as aryloxy groups, a dimethylamino group, diethylamino group, dipropylamino group, N-methyl-N-ethylamino group, N-ethyl-N-propylamino group, and N-methyl-N-propylamino group as dialkylamino groups, a methylthio group, ethylthio group and propylthio group as alkylthio groups, and a piperidino group, 1-peperazinyl group, morpholino group, and 1-pyrrolidyl group as N-containing heterocyclic groups. Examples of substituted alkyl groups include alkyl groups wherein at least one of the above described substituents bonds to any of the carbon atoms of the above described alkyl groups.

For $R^1$ and $R^2$ representing unsubstituted aralkyl groups, examples thereof include a benzyl group, phenetyl group, 1-naphthylmethyl group, 2-naphthylmethyl group, 1-anthrylmethyl group, and benzohydryl group. For $R^1$ and $R^2$ representing substituted aralkyl groups, examples of the substituents include the above described substituents. Examples of substituted aralkyl groups include aralkyl groups wherein at least one of the above described substituents bonds to any of the carbon atoms of the above described aralkyl groups.

For $R^1$ and $R^2$ representing unsubstituted aryl groups, examples thereof include a phenyl group, 1-naphthyl group, 2-naphthyl group, anthryl group, pyrenyl group, acenaphthenyl group and fluorenyl group. For $R^1$ and $R^2$ representing substituted aryl groups, examples of the substituents include a methyl group, ethyl group, propyl group, butyl group, pentyl group, isopropyl group, isobutyl group and isopentyl group as alkyl groups in addition to the above described substituents. Examples of the substituted aryl groups include aryl groups wherein at least one of the above described substituents bonds to any of the carbon atoms of the above described aryl group.

For $R^1$ and $R^2$ together forming a heterocyclic ring, an example of the heterocyclic ring is a carbazole ring.

It is preferred that one of $R^1$ and $R^2$ is a phenyl group and the other is a methyl group, an ethyl group, a benzyl group, a phenyl group, or a naphthyl group.

For $R^3$ through $R^{10}$ representing unsubstituted or substituted alkyl groups, unsubstituted or substituted aralkyl groups or unsubstituted or substituted aryl groups, examples thereof are the same as in the case of $R^1$ and $R^2$.

For $R^4$ and $R^7$ are halogen atoms, alkoxy groups, or aryloxy groups, examples thereof include chlorine bromine, and fluorine as halogen atoms, a methoxy group, ethoxy group, propoxy group, butoxy group, pentyloxy group as alkoxy groups, and a phenoxy group, o-tolyloxy group, m-tolyloxy group, p-tolyloxy group, 1-naphthyloxy group, and 2-naphthyloxy group as aryloxy groups.

An example of $R^5$ and $R^6$ together forming a N-containing heterocyclic group is a piperazinyl group.

Examples of suitable groups include a hydrogen atom, methyl group, ethyl group, phenyl group, benzyl group, p-(dimethylamino)phenyl group and p-(diethylamino)phenyl group as $R^3$, a hydrogen atom, methyl group, ethyl group, methoxy group, ethoxy group, bromine atom, chlorine atom, and fluorine atom as $R^4$ and $R^7$, a methyl group, ethyl group, n-butyl group, n-hexyl group, benzyl group, and phenyl group as $R^5$ and $R^6$, a phenyl group, dimethylaminophenyl group, and diethylaminophenyl group as $R^8$ and $R^9$, and a methyl group, ethyl group, and benzyl group as $R^{10}$.

Examples of X include a methylene group, ethylene group, propylene group, butylene group, pentylene group, hexylene group, laurylene group, p-xylylene group, 2,5-dichloro-p-xylylene group, 2,3,5,6-tetramethyl-p-xylylene group, and 1,4-dimethylenenaphthalene group.

Preferable examples of X are an ethylene group, butylene group, pentylene group, hexylene group, and p-xylylene group.

Examples of Y include an oxygen atom, sulfur atom, selenium atom, alkylimino group, and dimethyl-methylene group. The alkyl group in the alkylimino group preferably has from 1 to 8 carbon atoms. A preferable example of Y is sulfur atom.

Examples of hydrazone compounds represented by formulae (I)-(III) are described below.

(1)

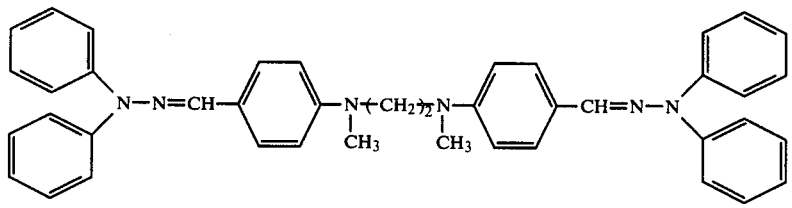

(2)

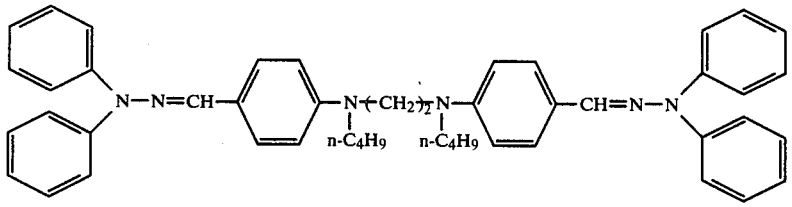

(3)

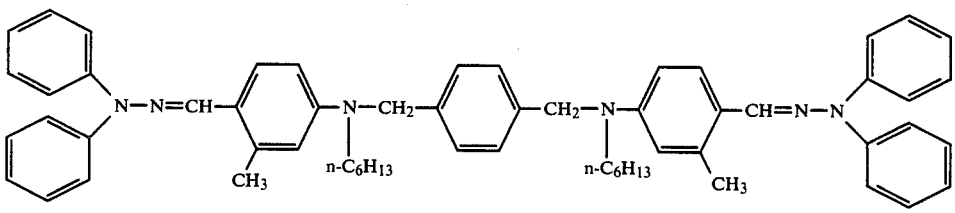

(4)

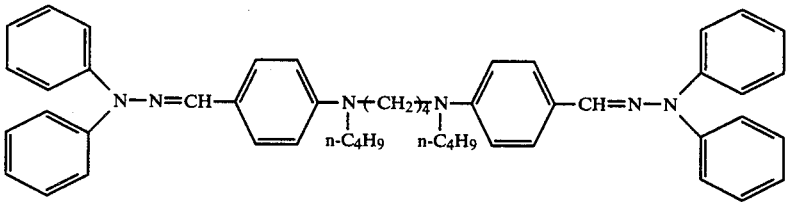

(5)

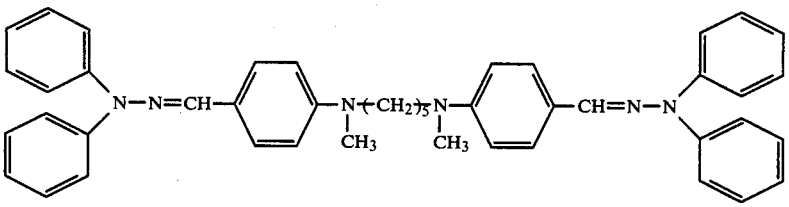

(6)

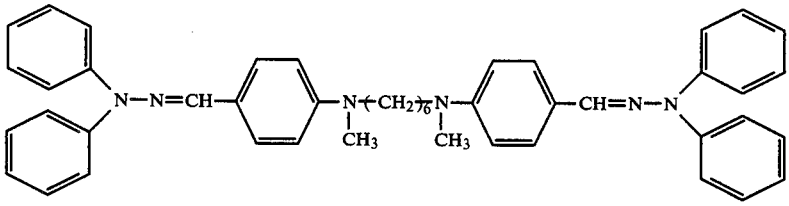

(7)

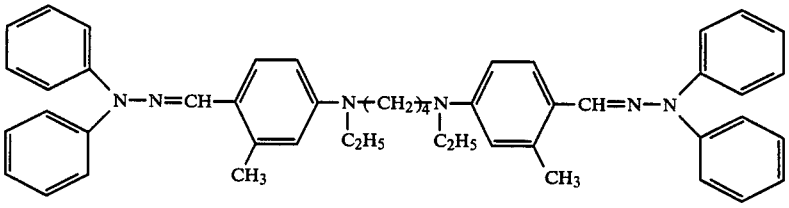

-continued
(8)
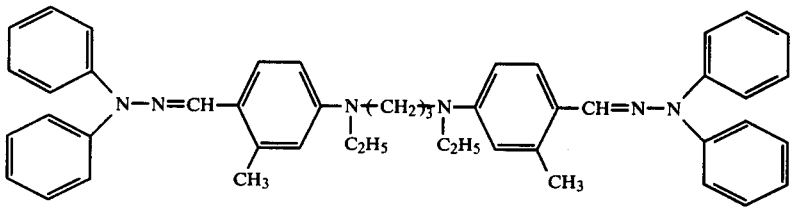
(9)
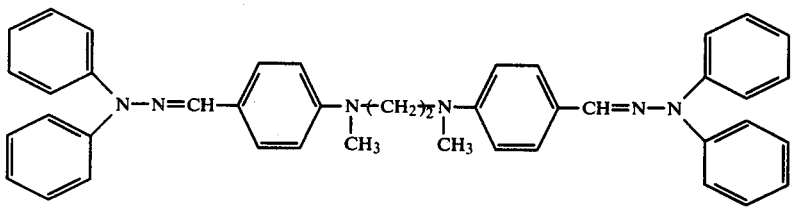
(10)
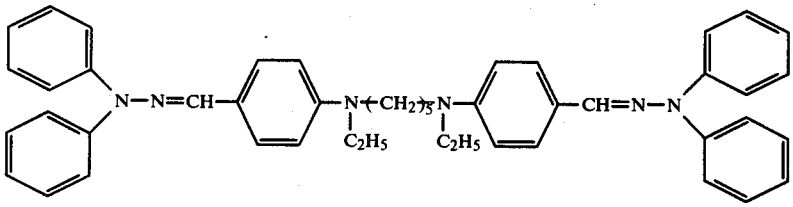
(11)
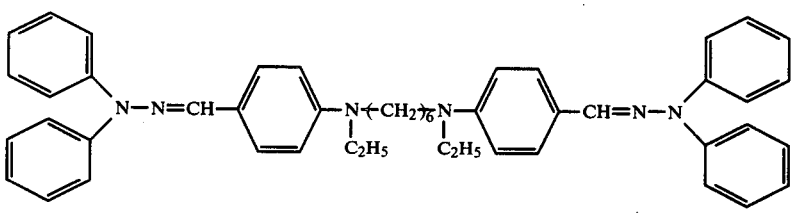
(12)
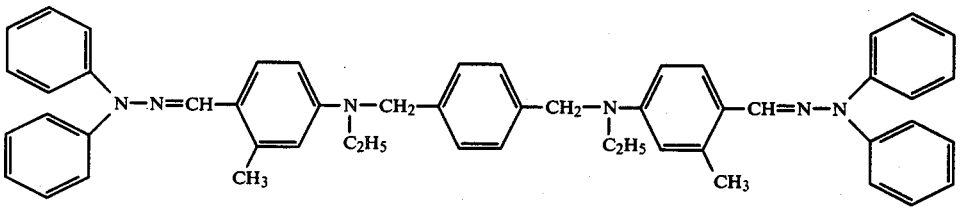
(13)
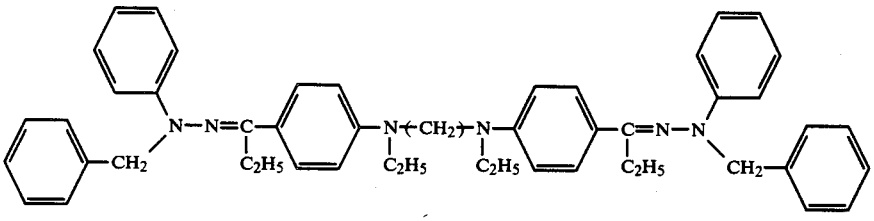
(14)
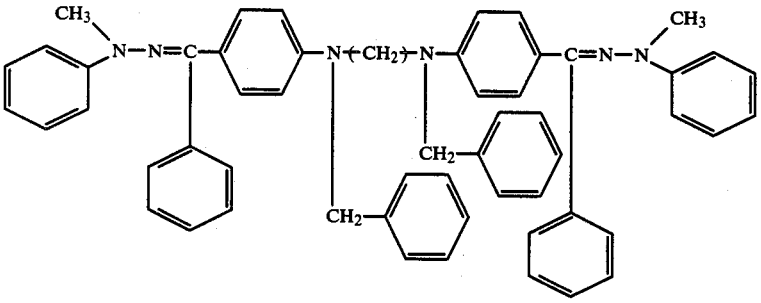

-continued
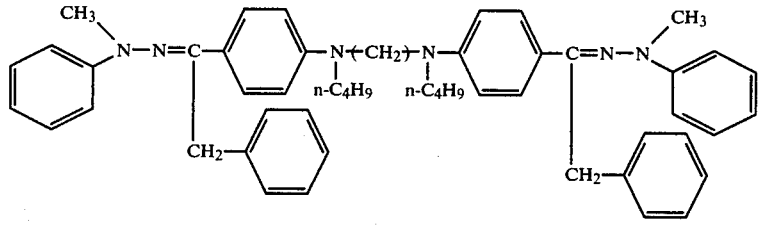
(15)
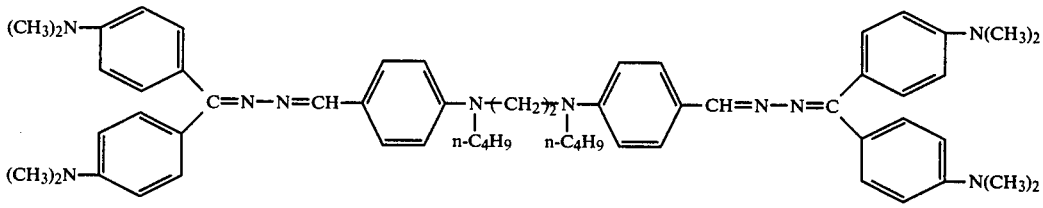
(16)
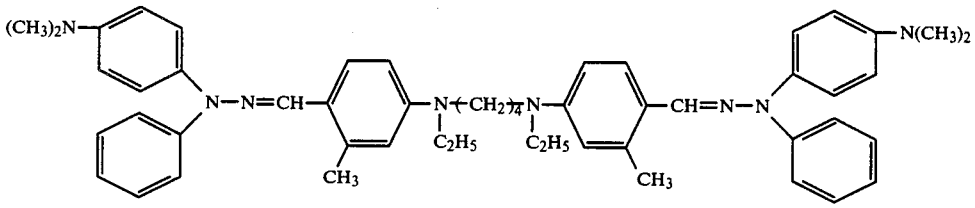
(17)
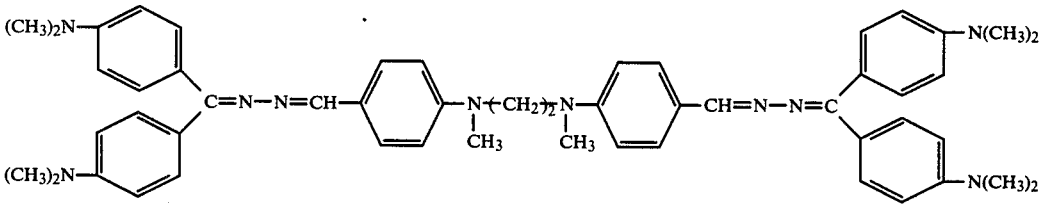
(18)
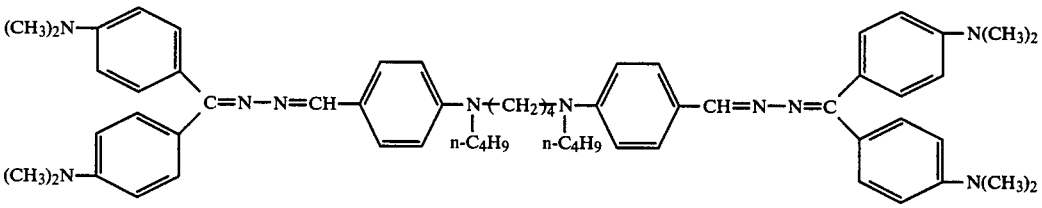
(19)
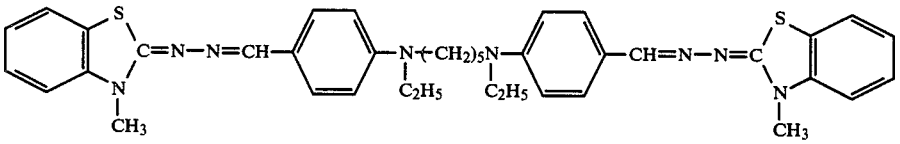
(20)
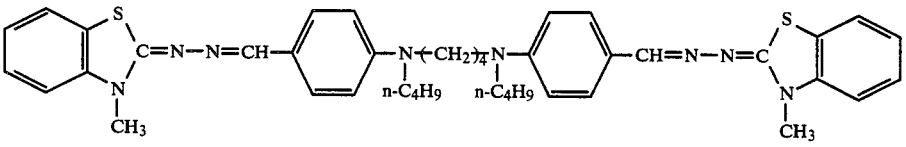
(21)

-continued
(22)
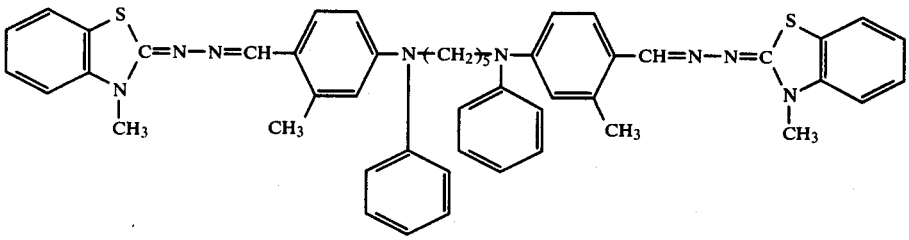
(23)
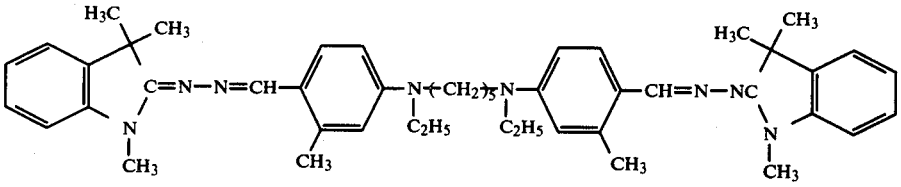
(24)
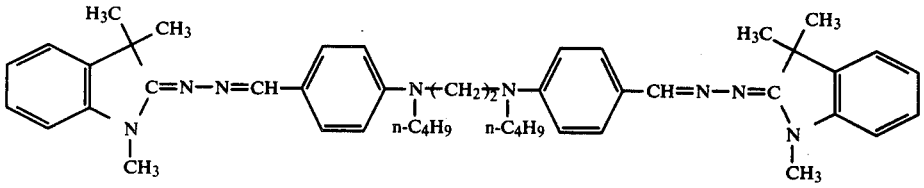
(25)
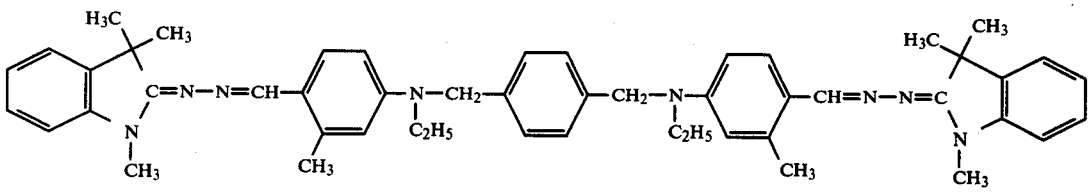
(26)
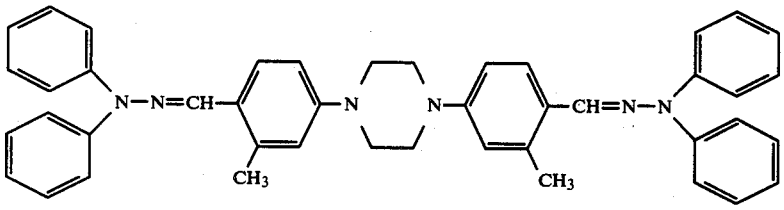
(27)
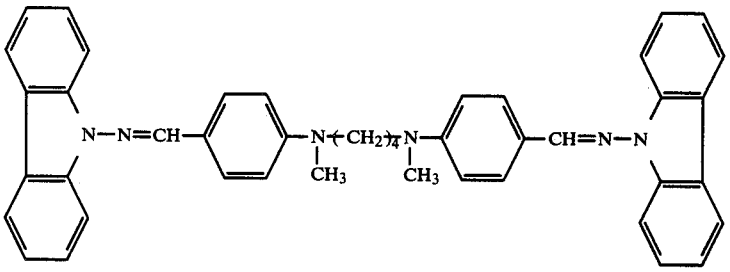
(28)
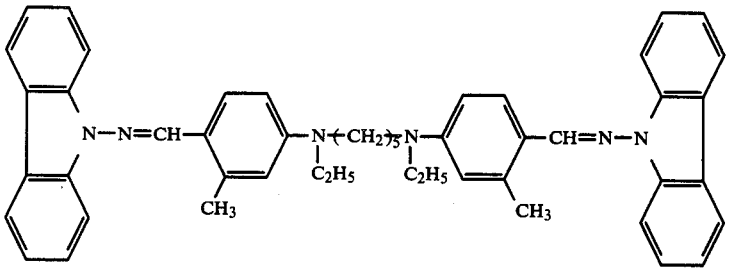

-continued (29)

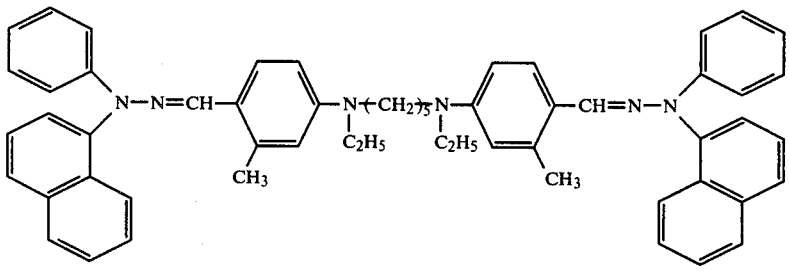

(30)

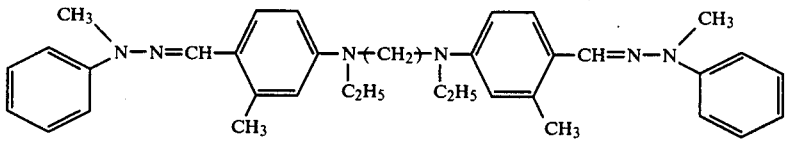

(31)

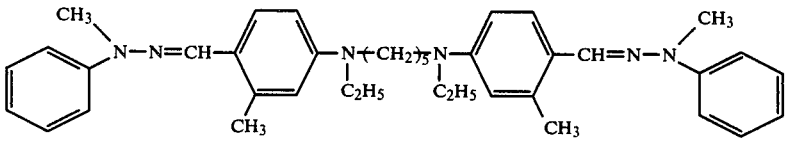

(32)

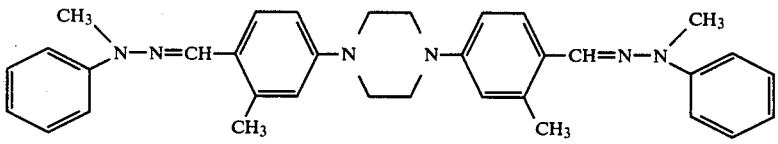

The hydrazone compounds represented by the above described formulae (I), (II), and (III) can be produced by processes described in the technical literature. Examples of such literature include *Preparative Organic Chemistry,* edited by G. Hilgetag and A. Martini (John Wiley & Sons, Ltd., New York, 1968), pages 508 et seq; *The Chemistry of the Carbon-Nitrogen Double Bond,* edited by S. Patai (Interscience Publishers, London, 1970), pages 71 et seq; an synthesis of a group of bisaldehydes is described in P. W. Hickmott, *J. Chem. Soc.,* (c), 1966 p. 666. More specifically, they can be produced by reacting a hydrazine represented by one of formulae (IV) to (VI) below, or a mineral acid salt thereof, with bisaldehyde or bisketone represented by formula (VII) below, in a solvent, adding, if necessary, a small amount of acid (e.g., glacial acetic acid or an inorganic acid) as a condensating agent. As the solvent, alcohols such as methanol, ethanol, etc., tetrahydrofuran, acetic acid, DMF (dimethyl formamide), etc., can be used alone or as a mixture thereof.

(IV)

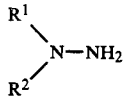

(V)

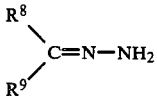

(VI)

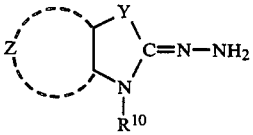

-continued (VII)

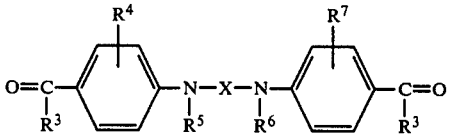

$R^1$ through $R^{10}$, X, Y, and Z in the formulae (IV) to (VII) each represent the same meanings as in the formulae (I) to (III).

SYNTHESIS EXAMPLE 4.4 g of 1,1-diphenylhydrazine hydrochloride and 3.52 g of bis(N-methyl-p-formylanilino)hexane were dissolved in 100 ml of DMF, and 2 g of sodium acetate was added thereto. The mixture was stirred at 90° C. for 4 hours. The reaction product was poured into 2 l of water with stirring to separate a yellow precipitate. After filtering off and drying, it was recrystallized from toluene/ethanol (ratio by volume: 1/1) to obtain 6.07 g of a bishydrazone compound (Compound (6)). Melting point: 151°–152° C.

| | As $C_{46}H_{48}N_6$ | | |
|---|---|---|---|
| Elemental analysis | C | H | N |
| Calculated value | 80.67 | 7.06 | 12.27 |
| Experimental | 80.71 | 6.98 | 12.33 |

Figure 5:
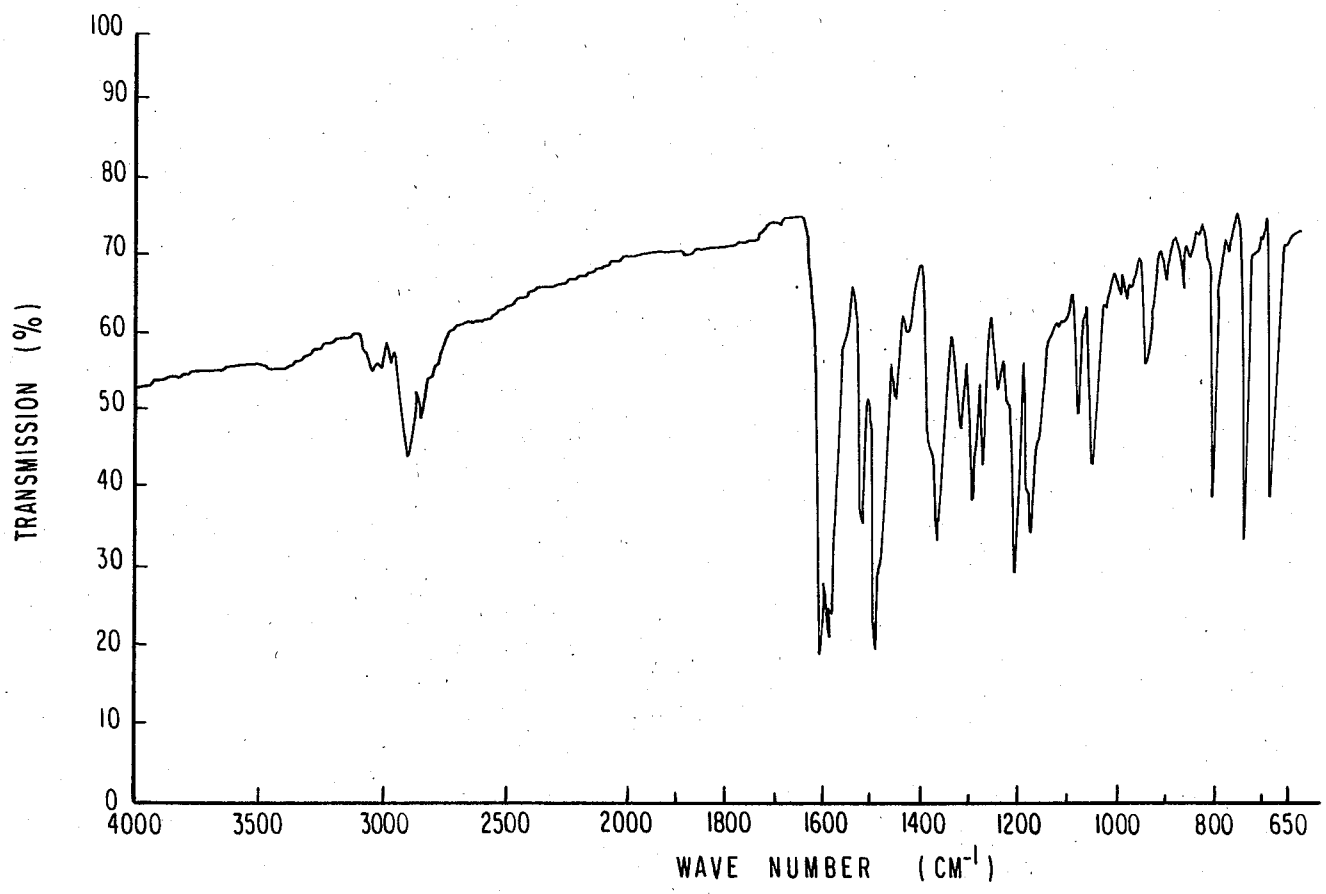
FIG. 5 is an infrared absorption spectrum (KBr tablet method) of the hydrazone compound (6) of the present invention.

An infrared absorption spectrum (KBr tablet method) is shown in FIG. 5.

Typical hydrazone compounds were synthesized in the same manner as in the above described synthesis example. When the melting point of the compounds was measured, the results shown in Table 1 were obtained.

TABLE 1

| Compound No. | Melting point |
|---|---|
| (2) | 149–150° C. |
| (4) | 134–137° C. |
| (5) | 167–169° C. |
| (7) | 147–150° C. |
| (8) | 133–136° C. |
| (9) | 140–142° C. |
| (10) | 145–149° C. |
| (11) | 147–150° C. |
| (12) | 198–200° C. |
| (20) | 182–184° C. |
| (21) | 177–178.5° C. |
| (26) | 211–212° C. |
| (30) | 134–135° C. |
| (31) | 94° C. |
| (32) | 196.5–201° C. |

The light-sensitive materials of the present invention contains hydrazone compounds as described above. These hydrazone compounds can be used as shown in FIGS. 1 to 4.

Figure 2:
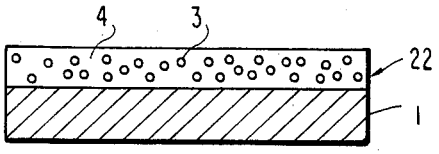

The light-sensitive material shown in FIG. 1 is that wherein a light-sensitive layer 21 composed of a hydrazone compound, a sensitizing dye, and a binder (resin) is provided on an electrically conductive support 1. The light-sensitive material shown in FIG. 2 is that wherein a light-sensitive layer 22 containing an electric charge generating substance 3 dispersed in an electric charge transporting medium 4 comprising of a hydrazone compound and a binder is provided on an electrically conductive support 1.

Figure 3:
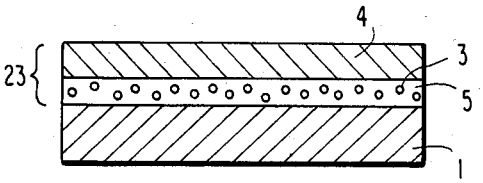

The light-sensitive material shown in FIG. 3 is that wherein a light-sensitive layer 23 comprising of an electric charge generating layer 5 containing an electric charge generating substance 3 as a main component and an electric charge transporting layer 4 containing a hydrazone compound is provided on an electrically conductive support 1. In this material, layer 5 is firstly provided on support 1 and layer 4 is provided on layer 5.

Figure 4:
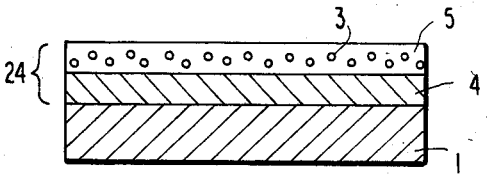

The light-sensitive material shown in FIG. 4 is that wherein a light-sensitive layer 24 comprising of an electric charge transporting layer 4 containing a hydrazone compound and an electric charge generating layer 5 containing an electric charge generating substance 3 as a main component is provided on an electrically conductive support 1. In this material, layer 4 is firstly provided on support 1 and layer 5 is provided on layer 4.

In the light-sensitive material shown in FIG. 1, the hydrazone compound acts as a photoconductive substance, and formation and transporting of electric charge carrier necessary for light-decay are conducted through the hydrazone compound. However, since the hydrazone compound hardly has any absorption in the visible range of light, it is necessary to sensitize by adding a sensitizing dye having absorption in the visible range in order to form an image with visible light.

In case of the light-sensitive material shown in FIG. 2, the hydrazone compound forms an electric charge transporting medium together with the binder (or binder and plasticizer), while the electric charge generating substance such as inorganic or organic pigment generates electric charges. In this case, the electric charge transporting medium has an ability of receiving and transporting electric charges generating chiefly from the electric charge generating substance. In this case, it is an essential requirement that the absorption wavelength range of the electric charge generating substance and that of the hydrazone compound do not overlap each other in mainly the visible range, because it is necessary to allow transmission of light to the surface of the electric charge generating substance in order to effectively generate electric charges in the electric charge generating substance. The hydrazone compounds used in the present invention hardly have absorption in the visible range. Accordingly, it is a characteristic thereof that they effectively serve as an electric charge transporting substance when combined with an electric charge generating substance which absorbs light of the visible range to generate electric charges.

In the light-sensitive material shown in FIG. 3, light passing through the electric charge transporting layer 4 reaches the electric charge generating layer 5 to cause generation of electric charges, while the electric charge transporting layer is subjected to injection of electric charges to conduct transporting thereof. Accordingly, the mechanism that generation of electric charges necessary for light-decay is conducted in the electric charge generating substance and transporting of electric charges is conducted by the electric charge transporting medium (the hydrazone compound of the present invention chiefly functions) is the same as that in case of the light-sensitive material shown in FIG. 2. In this case, the hydrazone compound serves as an electric charge transporting substance, too.

In the light-sensitive material shown in FIG. 4, generation of electric charges occurs in the electric charge generating layer 5 by light, while the electric charge transporting layer 4 is subjected to injection of electric charge to conduct transfer thereof. The mechanism of generation of electric charges necessary for light-decay and transporting of electric charges is the same as that in the cases of the light-sensitive materials shown in FIG. 2 and FIG. 3. In the case of FIG. 4, the hydrazine compound serves as an electric charge transporting substance.

In order to produce the light-sensitive material shown in FIG. 1, a liquid prepared by dissolving a hydrazone compound in a solution of the binder and adding, if necessary, a sensitizing dye, is applied to an electrically conductive support, and dried. In order to produce the light-sensitive material shown in FIG. 2, finely-divided grains of the electric charge generating substance are dispersed in a solution prepared by dissolving the hydrazone compound and the binder, and the resulted dispersion is applied to the electrically conductive support and dried. The light-sensitive material shown in FIG. 3 is produced by a process comprising (1) applying the electric charge generating substance to the electrically conductive support by vacuum evaporation or applying a dispersion prepared by dispersing finely divided grains of the electric charge generating substance in a suitable solvent, dissolving, if necessary, a binder to the electrically conductive support, (2) drying, (3) carrying out, if necessary, surface finishing by, for example, buff abrasion, or controlling the thickness of the film, and, thereafter, (4) applying a solution containing the hydrazone compound and the binder to the formed layer and (5) drying. Application is carried out by conventional means, for example, a doctor blade, a wire bar, etc.

The light-sensitive material shown in FIG. 4 is produced by providing the electric charge generating layer in the same manner as that in the light-sensitive material shown in FIG. 3, after a solution containing the hydrazone compound and the binder is applied to the electrically conductive support in a conventional manner and dried.

Thickness of the light-sensitive layer is generally in a range of from 1 to 50 μm, and, preferably, from 5 to 20 μm in the cases shown in FIGS. 1 and 2. In the cases shown in FIGS. 3 and 4, the suitable thickness of the electric charge generating layer is generally in a range of 5 μm to 0.01 μm and, preferably, from 2 μm to 0.05 μm, and the thickness of the electric charge transporting layer is in a range of from 3 to 50 μm, and, preferably, from 5 to 20 μm. In the light-sensitive material shown in FIG. 1, the proportion of the hydrazone compound in the light-sensitive layer is in a range of from 10 to 70% by weight, and, preferably, from 30 to 50% by weight based on the weight of the light-sensitive layer. The amount of the sensitizing dye used for giving sensitivity in the visible range is generally in a range of from 0.1 to 5% by weight, and, preferably, from 0.5 to 3% by weight, based on the weight of the light-sensitive layer. In the light-sensitive material shown in FIG. 2, the proportion of the hydrazone compound in the light-sensitive layer is generally in a range of from 10 to 95% by weight, and, preferably, from 30 to 90% by weight based on the weight of the light-sensitive layer, and the proportion of the electric charge generating substance in the light-sensitive layer is generally from 50% to 0.01% by weight, and, preferably, from 20% to 0.1% by weight based on the weight of the light-sensitive layer. In the light-sensitive materials shown in FIGS. 3 and 4, the proportion of the hydrazone compound in the electric charge transporting layer is generally in a range of from 10 to 95% by weight, and, preferably, from 30 to 90% by weight based on the weight of the electric charge transporting layer, similarly to the case of the light-sensitive layer in the light-sensitive material shown in FIG. 2, and the proportion of the electric charge generating substance is generally from 1 to 100% by weight, and, preferably, from 10 to 100% by weight based on the weight of the electric charge generating layer. In any of the light-sensitive materials shown in FIGS. 1 to 4, plasticizers can be used together with the binder.

In the light-sensitive materials of the present invention, as the electrically conductive supports, metal plates or metal foils such as of aluminum, etc., plastic films to which metal such as aluminum is applied by vacuum evaporation, and paper which is subjected to processing so as to have an electrically conductive property, etc., can be used. As the binders, condensation resins such as polyamide, polyurethane, polyester, epoxy resin, polyketone or polycarbonate, etc., and vinyl polymers such as polyvinylketone, polystyrene, poly-N-vinylcarbazole or polyacrylamide are used, but any resin can be used if it is electrically insulating and adhesive.

As the plasticizers, halogenated paraffin, polychlorobiphenyl, dimethylnaphthalene and dibutyl phthalate, etc., can be used.

As the sensitizing dyes used in the light-sensitive materials shown in FIG. 1, there are triarylmethane dyes such as Brilliant Green, Victoria Blue B, Methyl Violet. Crystal Violet, or Acid Violet 6B, xanthene dyes such as Rhodamine B, Rhodamine 6G, Rhodamine G extra, Eosine S, Erythrocin, Rose Bengale, or Fluoresceine, thiazine dyes such as Methylene Blue, Astrazone dyes such as C.I. Basic Violet 7 (C.I. 48020), cyanine dyes such as cyanine, and pyrylium dyes such as 2,6-diphenyl-4-(N,N-dimethylaminophenyl)-thiapyrylium perchlorate, or benzopyrylium salt (Japanese Patent Publication No. 25658/73 corresponding to U.S. Pat. No. 3,617,268), etc.

Examples of electric charge generating substances that can be used in the light-sensitive materials shown in FIG. 2, FIG. 3, and FIG. 4, include, for example, those described below.

(1) Selenium and selenium alloys.
(2) Inorganic photoconductive substances such as CdS, CdSe, CdSSe, ZnO, and ZnS.
(3) Phthalocyanine pigments such as metal phthalocyanines or metal-free phthalocyanines.
(4) Azo pigments.

For example, azo pigments having a carbazole skeleton as described in Japanese Patent Application (OPI) No. 95033/78 corresponding to U.S. Pat. No. 4,293,628, azo pigments having a triphenylamine skeleton as described in Japanese Patent Application (OPI) No. 132547/78 corresponding to U.S. Pat. No. 4,279,981, azo pigments having a styrylstilbene skeleton as described in Japanese Patent Application (OPI) No. 133445/78 corresponding to U.S. Pat. No. 4,272,598 and Japanese Patent Application (OPI) No. 42352/84, azo pigments having a naphthalene skeleton as described in Japanese Patent Application (OPI) No. 123541/83 and Japanese Patent Application (OPI) No. 192042/83, trisazo pigments as described in Japanese Patent Application (OPI) No. 217556/83, and azo pigments having a thiophene skeleton as described in Japanese Patent Application (OPI) No. 99042/83.

(5) Perylene pigments such as perylenic acid anhydride or perylenic acid imide, etc.
(6) Indigoid dyes.
(7) Quinacridone pigments,
(8) Polynuclear quinones such as anthraquinones, pyrenequinones, anthanthrones, flavanthrones, etc.
(9) Bisbenzimidazole pigments.
(10) Cyanine dyes.
(11) Squaric methine dyes.
(12) Indanthrone pigments.
(13) Xanthene dyes.
(14) Electric charge transfer complexes composed of an electron donative substance such as poly-N-vinylcarbazole, etc. and an electron-accepting substance such as trinitrofluorenone, etc.
(15) Eutectic crystal complexes formed from a pyrylium salt dye and a polycarbonate resin.
(16) Amorphous silicon.

As the electric charge generating substances, it is particularly preferred to use azo pigments.

In the light-sensitive materials obtained as described above, if desired, an adhesive layer or a barrier layer can be provided between the electrically conductive base and the light-sensitive layer. Materials used for these layers, include gelatin, casein, polyvinyl alcohol, ethyl cellulose, carboxymethyl cellulose, vinylidene chloride polymer latex as described in Japanese Patent Application (OPI) No. 84247/84, styrene-butadiene polymer latex as described in Japanese Patent Application (OPI) No. 115544/84, and aluminium oxide as well as the above described high polymers used for the binder. These layers are preferred to have a thickness of from 1 μm to 0.01 μm.

In the above, the electrophotographic light-sensitive materials of the present invention are illustrated in detail. The electrophotographic light-sensitive materials of the present invention generally have characteristics of having high sensitivity and excellent durability.

The electrophotographic light-sensitive materials of the present invention can be used not only for electrophotographic copying machines, but can also be widely used in the field of light-sensitive materials for printers using laser or a Braun tube as a light source.

As another use of the light-sensitive materials of the present invention, printing plates having high resolving power, high durability and high sensitivity are obtained by a process which comprises dispersing at least one of the compounds of formulae (I), (II), and (III) with an electric charge generating substance such as a dye or cupper phtharocyanine in an alkali soluble resin solution such as phenol resin, etc., applying the dispersion to an electrically conductive base such as aluminium, drying it, and thereafter subjecting it to imagewise exposure, development with a toner, and etching with an alkaline aqueous solution, as described in Japanese Patent Publication No. 17162/62 and Japanese Patent Applications (OPI) Nos. 19063/80, 161250/80, and 147656/82. In addition, it is possible to produce print circuits therewith.

In the following, the present invention is illustrated in greater detail with reference to the following examples, but the present invention is not restricted to the examples. In the examples, "part" means "part by weight".

EXAMPLE 1

To a grained aluminum plate having a thickness of about 300 μm, selenium was applied by vacuum evaporation so as to have a thickness of 0.4 μm to form an electric charge generating layer. To the resulting layer, a solution prepared by dissolving 10 parts of a hydrazone compound represented by the Compound (2) and 10 parts of polycarbonate of bisphenol A (trade mark: Lexan −121, produced by General Electric Co.) in 130 parts of dichloromethane was applied with a wire round rod and dried to form an electric charge transporting layer having a thickness of about 12 μm. Thus an electrophotographic light-sensitive material having a light-sensitive layer consisting of two layers was produced.

This light-sensitive material was electrified negatively by corona discharge at −5 KV by means of a testing apparatus for electrostatic copying paper (type SP-428, produced by Kawaguchi Denki Mfg.) and it was then exposed to light with a tungsten lamp having a color temparature of 2854° K. so that the surface had an illuminance of 2.0 luxes. The time required for reducing the surface electric potential to half of the initial surface electric potential was measured, and the half-decay exposure amount ($E_{50}$: lux.sec) was obtained.

As the result, $E_{50}$=1.9 luxes.sec.

$E_{50}$ after the electrification and exposure were repeated 3000 times was 2.01 luxes.sec, and variation of the sensitivity was very small.

EXAMPLES 2–6

Light-sensitive materials having a two-layer structure were produced in the same manner as in Example 1, except that hydrazone compounds represented by Compounds (3), (4), (16), (23) and (27) were used, respectively, instead of the hydrazone compound (2) in Example 1. The half-decay exposure amount ($E_{50}$) by negative electrification was measured in the same manner as in Example 1, and the following values were obtained.

| Example | Hydrazone compound used | $E_{50}$ (lux · sec) |
|---|---|---|
| 2 | (3) | 2.5 |
| 3 | (4) | 1.4 |
| 4 | (16) | 4.5 |
| 5 | (23) | 5.9 |
| 6 | (27) | 3.2 |

EXAMPLE 7

5 parts of β-type copper phthalocyanine were added to 660 parts of dichloromethane. After carried out ultrasonic dispersion, 40 parts of polycarbonate of bisphenol A (Lexan −121) and 40 parts of a hydrazone compound represented by Compound (2) were added to and dissolved in the resulting dispersion to prepare a coating solution. The resulting coating solution was applied to an electrically conductive transparent base (which had an indium oxide film formed by vacuum evaporation on a polyethylene terephthalate base of 100 μm; surface resistance: $10^3\Omega$) with a wire round rod and dried to obtain a light-sensitive material having coated thereon a light-sensitive layer having a thickness of about 10 μm.

After this light-sensitive material was electrified positively by corona discharge at +5 KV, the half-decay exposure amount ($E_{50}$) was measured. $E_{50}$=3.7 luxes.sec.

EXAMPLE 8

2 parts of disazo pigment having the following structural formula and 4 parts of polyester resin (Vylon 200, produced by Toyo Boseki Co.) were added to 7 parts of tetrahydrofuran. After the mixture was dispersed by a paint shaker, the resulting dispersion was applied to an electrically conductive support (which had an aluminum film formed by vacuum evaporation on a polyethylene terephthalate base of 100 μm; surface resistance=$10^3\Omega$) with a wire round rod, and dried to obtain an electric charge generating layer having a thickness of about 0.5 μm.

Then, a solution obtained by dissolving 10 parts of a hydrazone compound represented by Compound (2) and 10 parts of polycarbonate of bisphenol A (Lexan −121) in 120 parts of dichloromethane was applied with a wire round rod and dried to form an electric charge transporting layer having a thickness of about 14 μm.

When the half-decay exposure amount ($E_{50}$) of the resulting light-sensitive material composed of two layers was measured in the same manner as in Example 1, it was 1.7 luxes.sec.

(Disazo pigment)

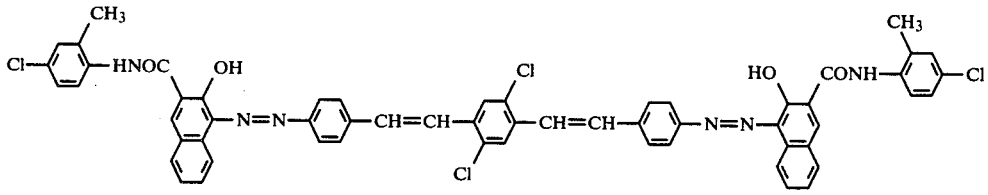

EXAMPLES 9–20

Light-sensitive materials having a two layer structure were produced in the same manner as in Example 8, except that Compounds (4), (5), (6), (7), (8), (9), (10), (11), (19), (20), (26), and (27) were used instead of the hydrazone compound (2) in Example 8. Half-decay exposure amount by negative electrification ($E_{50}$) was measured in the same manner as in Example 1, and the following values were obtained.

| Example | Hydrazone compound used | $E_{50}$ (lux · sec) |
|---|---|---|
| 9 | (4) | 1.7 |
| 10 | (5) | 2.9 |
| 11 | (6) | 2.2 |
| 12 | (7) | 2.4 |
| 13 | (8) | 1.9 |
| 14 | (9) | 2.4 |
| 15 | (10) | 2.3 |
| 16 | (11) | 1.9 |
| 17 | (19) | 3.5 |
| 18 | (20) | 2.9 |
| 19 | (26) | 1.8 |
| 20 | (27) | 3.0 |

EXAMPLE 21

8 parts of a hydrazone compound represented by Compound (2), 10 parts of polycarbonate of bisphenol A (Lexan 121) and 0.12 parts of an Astrazone dye having a structural formula as described below were added to 110 parts of dichloromethane and dissolved therein to prepare a coating solution.

This coating solution was applied to an electrically conductive transparent support (which had an indium oxide layer formed by vacuum evaporation on a polyethylene terephthalate base of 100 μm; surface resistance: $10^3\Omega$) with a wire round rod and dried to obtain a light-sensitive material having coated thereon a light-sensitive layer having a thickness of about 10 μm.

After this light-sensitive material was electrified positively by corona discharge at +5 KV, the half-decay exposure amount ($E_{50}$) was measured. $E_{50}$=18.2 luxes.-sec.

(Astrazone dye)

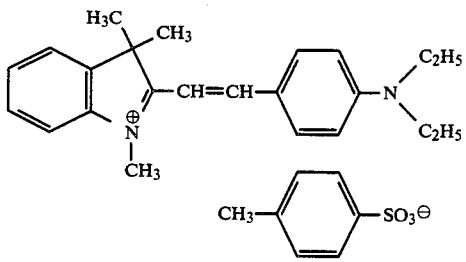

EXAMPLE 22

5 parts of disazo dye used in Example 8, 40 parts of a hydrazone compound represented by Compound (2), and 100 parts of benzyl methacrylate-methacrylic acid copolymer ([γ]30° C. methyl ethyl ketone=0.12; methacrylic acid content: 32.9 mole %) were added to 660 parts of dichloromethane, and the mixture was subjected to ultrasonic dispersion. The resulting dispersion was applied to a grained aluminum plate having a thickness of 0.25 mm and dried to prepare an electrophotographic light-sensitive printing plate material having an electrophotographic light-sensitive layer having a dry film thickness of 6 mm.

After the sample was electrified in the dark by corona discharge (+6 KV) so that the surface electric potential of the light-sensitive layer was about +600 V, it was exposed to tungsten light having a color temperature of 2854° K. so as to provide an illuminance of 2.0 luxes. The half-decay exposure amount ($E_{50}$) was 1.4 luxes.sec.

Then, this sample was electrified in the dark so as to have a surface electric potential of about +400 V, and thereafter, it was imagewise exposed to light in close contact with a transmission original having a positive image. When it was immersed in a liquid developer which was prepared by adding 5 g of finely devided polymethyl methacrylate (toner) and 0.01 g of soybean lecithin to 1 l of Isopar H (petroleum type solvent, produced by Esso Standard Co.), a clear positive toner image could be obtained.

It was then heated to 100° C. for 30 seconds to fix the toner image. The resulting printing plate material was immersed in a liquid prepared by dissolving 70 g of sodium metasilicate hydrate in a mixture of 140 ml of glycerine, 550 ml of ethylene glycol and 150 ml of ethanol for about 1 minute, and it was washed with flowing water by slightly brushing, whereby the electrophotographic light-sensitive layer of the part where the toner did not adhere was removed.

Alternatively, the formed electrostatic latent image was developed with a magnetic brush using a toner for Xerox 3500 (produced by Fuji Xerox Co.) instead of the liquid developer, and fixation was carried out by heating to 80° C. for 30 seconds. Then, the light-sensitive layer on the part where the toner did not adhere was removed with an alkali solution, to obtain a printing plate.

When printing was carried out using the resulting printing plate by means of an offset printer: Hamadastar 600 CD (Trade Mark for printer, manufactured by Hamada Insatsuki Co. Ltd.) in a conventional manner, 50,000 sheets of very clear print having no stain were obtained.

While the invention has been described in detail and with reference to specific embodiments thereof, it will be apparent to one skilled in the art that various changes and modifications can be made therein without departing from the spirit and the scope thereof.

What is claimed is:

1. An electrophotographic light-sensitive material comprising, provided on an electrically conductive support, a light-sensitive layer containing at least one hydrazone compound selected from the group consisting of compounds represented by formulae (I), (II), and (III) and a binder:

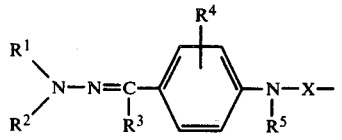

(I)

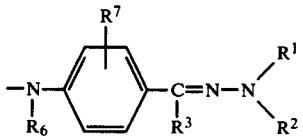

(II)

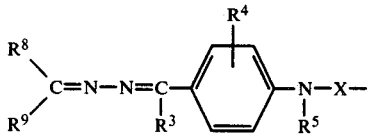

(III)

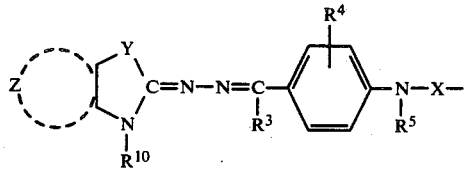

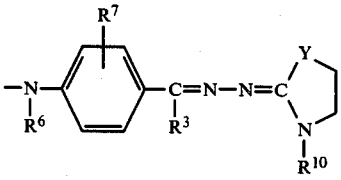

Z wherein $R^1$ and $R^2$ each is an unsubstituted or substituted straight chain or branched chain alkyl group having from 1 to 12 carbon atoms, an unsubstituted or substituted straight chain or branched chain aralkyl group having from 7 to 20 carbon atoms, or a monovalent group formed by removing one hydrogen atom from a mononuclear or 2- to 4-nuclear condensed polycyclic aromatic hydrocarbon having from 6 to 20 carbon atoms, or $R^1$ and $R^2$ together form a heterocyclic ring, $R^3$ is a hydrogen atom, an unsubstituted or substituted straight chain or branched chain alkyl group having from 1 to 12 carbon atoms, an unsubstituted or substituted aralkyl group having from 7 to 20 carbon atoms, or an unsubstituted or substituted aryl group having from 6 to 20 carbon atoms, $R^4$ and $R^7$ each is a hydrogen atom, an unsubstituted or substituted straight chain or branched chain alkyl group having from 1 to 12 carbon atoms, an unsubstituted or substituted aralkyl group having from 7 to 20 carbon atoms, an unsubstituted or substituted aryl group having from 6 to 20 carbon atoms, a halogen atom, an alkoxy group having from 1 to 12 carbon atoms, or an aryloxy group having from 6 to 14 carbon atoms, $R^5$, $R^6$, $R^8$, $R^9$, and $R^{10}$ each is an unsubstituted or substituted straight chain or branched chain alkyl group having from 1 to 12 carbon atoms, an unsubstituted or substituted straight chain or branched chain aralkyl group having from 7 to 20 carbon atoms, or an unsubstituted or substituted aryl group having from 6 to 20 carbon atoms, or $R^5$ and $R^6$ together form an N-containing heterocyclic group, and X is the formula

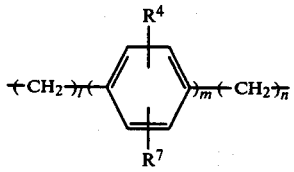

wherein l and n are each 0 or an integer of 1 to 6, m is 0 or 1, and $l+m+n>0$, $R^4$ and $R^7$ each is the same substituent as described above for $R^4$ and $R^7$, or $R^4$ and $R^7$ together form a condensed polynuclear aromatic ring, Y is an oxygen atom, a sulfur atom, a selenium atom, an unsubstituted or substituted imino group, or an unsubstituted or substituted methylene group, and Z is an atomic group forming a benzene or naphthalene ring.

2. An electrophotographic light-sensitive material as in claim 1, wherein the substituent of any of the groups represented by $R^1$ through $R^{10}$ is selected from the group consisting of a halogen atom, alkoxy group, aryloxy group, dialkylamino group, alkylthio group and nitrogen-containing heterocyclic group.

3. An electrophotographic light-sensitive material as in claim 1, wherein the heterocyclic ring formed by $R^1$ and $R^2$ is a carbazole ring.

4. An electrophotographic light-sensitive material as in claim 1, wherein one of $R^1$ and $R^2$ is a phenyl group and the other is a group selected from the group consisting of a methyl group, an ethyl group, a benzyl group, a phenyl group and a naphthyl group.

5. An electrophotographic light-sensitive material as in claim 1, wherein N-containing heterocyclic group formed by $R^5$ and $R^6$ is a piperazinyl group.

6. An electrophotographic light-sensitive material as in claim 1, wherein said substituted imino group represented by Y is an alkylimino group.

7. An electrophotographic light-sensitive material as in claim 1, wherein said substituted methylene group is a dimethylmethylene group.

8. An electrophotographic light-sensitive material as in claim 1, wherein the light-sensitive material comprises of an electrically conductive support having thereon a light-sensitive layer comprising of at least one of said hydrazone compounds, a sensitive dye and a binder.

9. An electrophotographic light-sensitive material as in claim 1, wherein the light-sensitive material comprises of an electrically conductive support having thereon a light-sensitive layer comprising of an electric charge generating substance dispersed in an electric charge transporting medium comprising of at least one of said hydrazone compounds and a binder.

10. An electrophotographic light-sensitive material as in claim 1, wherein the light-sensitive material comprises of an electrically conductive support having thereon a light-sensitive layer comprising of an electric charge generating layer containing an electric charge generating substance and an electric charge trnasporting layer containing at least one of said hydrazone compounds.

11. An electrophotographic light-sensitive material as in claim 10, wherein said electric charge generating layer is provided on the support and said electric charge transporting layer is provided on the electric charge generating layer.

12. An electrophotographic light-sensitive material as in claim 10, wherein said electric charge conveying layer is provided on the support and said electric charge generating layer is provided on the electric charge conveying layer.

13. An electrophotographic light-sensitive material as in claim 8, wherein the thickness of said light-sensitive layer is from 1 μm to 50 μm.

14. An electrophotographic light-sensitive material as in claim 9, wherein the thickness of said light-sensitive layer is from 1 μm to 50 μm.

15. An electrophotographic light-sensitive material as in claim 10, wherein the thickness of said electric charge generating layer is from 5μ to 0.01μ.

16. An electrophotographic light-sensitive material as in claim 10, wherein the thickness of said electric charge conveying layer is from 3 to 50μ.

17. An electrophotographic light-sensitive material as in claim 8, wherein the proportion of the hydrazone compound is from 10 to 70% by weight based on the weight of the light-sensitive layer.

18. An electrophotographic light-sensitive material as in claim 9, wherein the amount of said hydrazone compound is from 10 to 95% by weight, and the amount of said electric charge generating substance is from 50 to 0.01% by weight each based on the weight of the light-sensitive layer.

19. An electrophotographic light-sensitive material as in claim 10, wherein the amount of said hydrazone compound is from 10 to 95% by based on the wieght of the electric charge transporting layer.

20. An electrophotographic light-sensitive material as in claim 10, wherein the amount of said electric charge generating substance is from 1 to 100% by weight based on the weight of the electric charge generating layer.

* * * * *